United States Patent [19]

Carbone et al.

[11] 4,266,771

[45] May 12, 1981

[54] FLEXIBLE PLAYING CARD DISPLAY RACK

[76] Inventors: Peter Carbone, c/o George Spector 3615 Woolworth Bldg., 233 Broadway, Jackson Heights; George Spector, 3615 Woolworth Bldg., 233 Broadway, both of New York, N.Y. 10007

[21] Appl. No.: 48,749

[22] Filed: Jun. 15, 1979

[51] Int. Cl.[3] ..... A63F 1/00

[52] U.S. Cl. ..... 273/150; 40/124.2

[58] Field of Search ..... 273/150; 40/124.2

[56] References Cited

U.S. PATENT DOCUMENTS

| | | | |
|---|---|---|---|
| 1,076,850 | 10/1913 | Wedderburn | 273/150 |
| 3,323,801 | 6/1967 | Babcock | 273/150 |
| 3,791,651 | 2/1974 | Barnum et al. | 273/150 |

*Primary Examiner*—Anton O. Oechsle

[57] ABSTRACT

A rack for handing a hand of playing cards in a displayed position to a player, the rack including an elongated thin container having a narrow opening on its top so that upper ends of spread out cards are visible, and a base supporting the container upright, and various designs of the invention being presented so that the rack is either foldable, bendable, or else components thereof are interslidable together in various ways.

3 Claims, 9 Drawing Figures

FLEXIBLE PLAYING CARD DISPLAY RACK

This invention relates generally to card players accessories.

It is well known that many persons who enjoy playing cards may be handicapped persons such as who have the use of only one hand, or who may have arthritis, which prevents the card player to hold his cards in a hand, so that he may try leaning them against his arm on the table or otherwise try to view them without players seeing them. This situation is not ideal and is therefore in need of an improvement.

Accordingly, it is a principal object of the present invention to provide a rack upon which a hand of cards can be displayed in a spread out condition to the player while not being visible to other players, the rack eliminating a need to hold the cards in a hand.

Another object is to provide a playing card rack which prevents a hand getting cramps such as when trying to hold from five to fifteen cards in a spread position for long periods.

Figures 1, 2, 3, 4, 5, 6, 7, 8, 9:
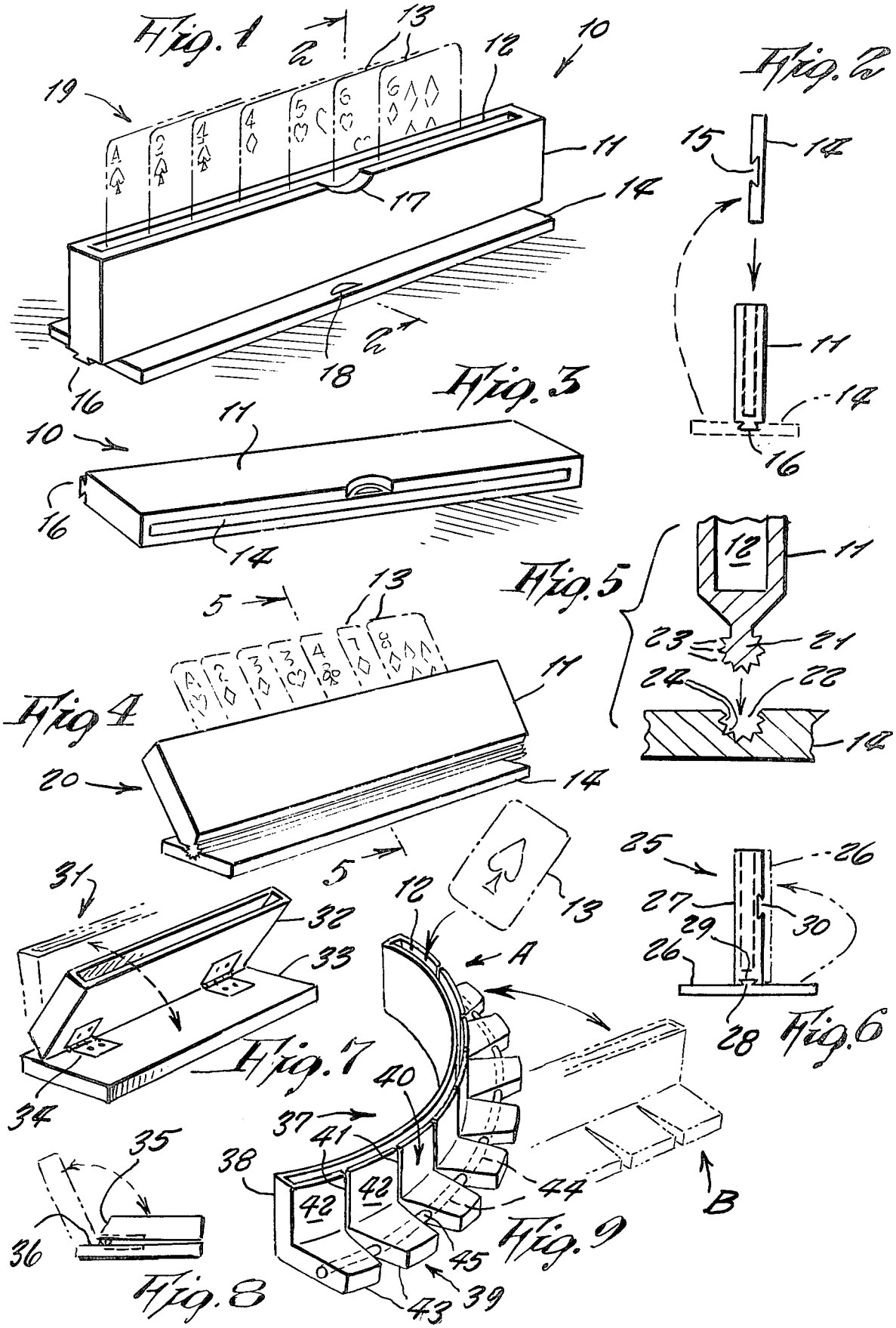
FIG. 1 is a perspective view of one design of the invention.
FIG. 2 is a cross sectional view on line 2—2 of FIG. 1, and showing the device dis-assembled.
FIG. 3 shows it in stored away position.
FIG. 4 shows another design which is selectively tiltable.
FIG. 5 is a cross section on line 5—5 of FIG. 4, shown enlarged and fragmentary.
FIG. 6 shows still another variation of the design of FIG. 2.
FIG. 7 shows a foldable design thereof.
FIG. 8 is an end view thereof.
FIG. 9 shows still another design that can be curved as wished, and which includes a stiffening rod extending through the feet of the device so that it keeps any shape as wanted, the rod being made of lead so to have no springiness therein.

Referring now to the drawing in greater detail, and more particularly to FIGS. 1 to 3 thereof at this time, the reference numeral 10 represents a Helping Hand playing card rack according to the present invention wherein there is a flat thin box or container 11 having a narrow opening 12 on top so that playing cards 13 can be inserted therein. The depth of the opening is less than a height of a conventional playing card in order that an upper end of the cards protrude upwardly therefrom in order to be visible. The box is supported upright upon a base 14 comprising a flat plate, having a longitudinal groove 15 slidably receiving a tongue 16 formed on an underside of the box. The box and base may be made of any desired material so to be attractive and efficient in use. They may be either of wood, plastic, ceramic, rubber or the like. Preferably the device may be molded of hard plastic, in any color, so to be inexpensive to produce.

When the rack is not intended to be used, it may be conveniently stored away in a minimum space by first sliding the base off the box bottom as shown in FIG. 2, and the base then being slided into the opening 12 wherein it completely fits flush as shown in FIG. 3. A notch 17 in the box allows access for a persons finger nail to be inserted in a finger nail recess 18 on the base in order that the base can be subsequently pulled out of the opening.

In use, the length of the opening, allows a hand of cards to be spread out as shown at 19 in order that each card can be clearly seen by the player.

In FIGS. 4 and 5, another design of rack 20 is generally a same as rack 10 except instead the above described groove and tongue, the present design includes a cylindrical shaped tongue 21 fitted in a cylindrical groove 22, one of which has teeth 23 that fit in notches 24 of the other. The box can be tilted any desired angle as shown, as all teeth and notches interfit.

In FIG. 6, a variation 25 of the design shown in FIG. 2, allows a base 26 to be stored along a side of the box 27 by means of a tongue 28 on the base, normally used to engage groove 29 on the box bottom when in use, being now engagable in a groove 30 along an outer side of the box.

In FIGS. 7 and 8, still another design of rack 31 includes box 32 and base 33 being pivotally attached together by hinges 34, so that in stored away position, they pivot into side by side position shown in FIG. 8. In use, an inclined bottom wall 35 of the box, abuts a top surface 36 of the base. In FIG. 9, still another design of rack 37 is molded of a resilient rubber or plastic, a box 38 being integral with a base 39, one side wall 40 of the box is slitted to its lower edge with slits 41 so to form wall segments 42 each of which is made integral with a sidewardly extending foot 43, the feet together forming the base 39. A horizontal hole 44 through each foot is all fitted slidably free with a single rod 45 which is made of a flexible dead metal such as lead so that when flexed in any position, it will not spring back.

Thus in this design, the rack may be flexed into an desired shape as suggested at A or B, due to the rack flexibility, and which is retained in the shape made, by the rod which then holds the shape that is selected.

What is claimed:

1. A playing card display rack, comprising in combination, a narrow box in which playing cards can be displayed in spread out position, and a base for holding said box upright, and said rack being made of a material for selective flexing thereof, wherein said rack includes means for retaining said rack in arcuate flexed positions.

2. A rack as in claim 1 wherein said means comprise an elongated flexible rod mounted on said rack, said rod having the property of retaining varying flexed positions.

3. A rack as in claim 1 wherein the base and box are partially segmented at spaced intervals to increase flexibility.

* * * * *